US010577794B2

(12) United States Patent
Burke

(10) Patent No.: US 10,577,794 B2
(45) Date of Patent: Mar. 3, 2020

(54) WALL CONSTRUCTION

(71) Applicant: Designstone Pty Ltd, Mandurah, WA (US)

(72) Inventor: David Allan Burke, Halls Head (AU)

(73) Assignee: DesignStone Pty Ltd., Mandurah, WA (AU)

( * ) Notice: Subject to any disclaimer, the term of this patent is extended or adjusted under 35 U.S.C. 154(b) by 0 days.

(21) Appl. No.: 15/442,746

(22) Filed: Feb. 27, 2017

(65) Prior Publication Data

US 2017/0254070 A1 Sep. 7, 2017

(30) Foreign Application Priority Data

Mar. 2, 2016 (AU) ..... 2016900776

(51) Int. Cl.

| | |
|---|---|
| ***E04B 2/62*** | (2006.01) |
| ***E04B 2/64*** | (2006.01) |
| *E04F 13/08* | (2006.01) |
| *E04F 13/14* | (2006.01) |
| *E04B 2/58* | (2006.01) |
| *E04B 1/16* | (2006.01) |

(52) U.S. Cl.

CPC ..... *E04B 2/64* (2013.01); *E04B 1/165* (2013.01); *E04B 2/58* (2013.01)

(58) Field of Classification Search

CPC ..... E04B 2/62; E04B 2/64; E04B 2/58; E04B 1/165; E04F 13/14; E04F 13/0832

USPC ..... 52/489.1

See application file for complete search history.

(56) References Cited

U.S. PATENT DOCUMENTS

| | | | | | |
|---|---|---|---|---|---|
| 1,798,197 | A * | 3/1931 | Eichner | E04B 2/62 | 52/243 |
| 1,876,756 | A * | 9/1932 | Robinson | E04B 2/58 | 52/349 |
| 2,016,566 | A * | 10/1935 | Winship | B62D 27/02 | 296/210 |
| 2,223,016 | A * | 11/1940 | Parkhurst | E04B 1/04 | 52/22 |
| 2,664,740 | A * | 1/1954 | Cochrane | E04B 2/58 | 52/781 |
| 3,216,156 | A * | 11/1965 | Carew | E04B 1/24 | 52/274 |
| 3,478,480 | A * | 11/1969 | Swenson | E04F 13/0825 | 52/235 |
| 3,530,631 | A * | 9/1970 | Guddal | E04B 2/842 | 52/414 |

(Continued)

FOREIGN PATENT DOCUMENTS

| | | | | |
|---|---|---|---|---|
| AU | 641920 B | | 11/1990 | |
| AU | 641920 B2 | * | 10/1993 | |
| WO | WO-2014022884 A1 | * | 2/2014 | E04B 1/165 |

*Primary Examiner* — Patrick J Maestri
*Assistant Examiner* — Joseph J. Sadlon
(74) *Attorney, Agent, or Firm* — Hooker & Habib, P.C.

(57) ABSTRACT

A wall construction includes a number of spaced apart, upright channel-shaped studs having open upper ends, and a number of panels forming an exterior wall. The panels have tie members that extend into the studs. An elongate support member is attached to the studs adjacent to the upper ends of the studs. The support member does not block access to the upper ends of the studs so that the studs can be filled with concrete with the support member remaining in place attached to the studs.

13 Claims, 3 Drawing Sheets

(56) References Cited

U.S. PATENT DOCUMENTS 3,563,577 A * 2/1971 Wittenmayer ..... E04B 1/6816 292/216
3,698,147 A * 10/1972 Sikes ..... E04B 1/6141 52/250
3,733,757 A * 5/1973 Scott ..... E04B 1/215 52/105
4,161,852 A * 7/1979 Schultz ..... E04B 1/0007 52/250
4,409,764 A * 10/1983 Wilnau ..... E04B 1/165 52/127.3
4,413,454 A * 11/1983 Milh ..... E04B 1/04 52/236.6
4,433,514 A * 2/1984 Henges, Jr. ..... E04B 1/34326 52/262
4,512,126 A * 4/1985 Walston ..... E04B 1/14 52/251
4,742,665 A * 5/1988 Baierl ..... E04B 1/24 52/276
5,111,628 A * 5/1992 Desjoyaux ..... E04H 4/0081 249/13
5,511,761 A * 4/1996 Schultz ..... E04G 11/10 249/155
6,092,340 A * 7/2000 Simmons ..... E04B 1/24 52/481.1
6,244,005 B1 * 6/2001 Wallin ..... E02D 29/02 249/19
6,945,001 B1 * 9/2005 Suzuki ..... E04B 7/22 53/309.14
7,533,508 B1 * 5/2009 diGirolamo ..... E04B 2/58 248/300
8,635,828 B2 * 1/2014 Bahnmiller ..... B32B 5/14 52/309.4
8,713,871 B2 * 5/2014 Wallin ..... E02D 29/0275 52/250
9,482,003 B2 * 11/2016 Browning ..... E04C 1/41
9,856,639 B2 * 1/2018 Koszo ..... E04B 1/165
2008/0222981 A1 * 9/2008 De Gobbi ..... E04B 1/41 52/235

* cited by examiner

WALL CONSTRUCTION

RELATED APPLICATION

This application claims priority from co-pending Australian Provisional Patent Application No. 2016900776 "A Wall Construction" filed Mar. 2, 2016, with inventor David Allan Burke and applicant Designstone Pty Ltd, which priority application is incorporated by reference as if fully set forth herein.

FIELD OF THE DISCLOSURE

The disclosure relates generally to a wall construction for buildings.

BACKGROUND OF THE DISCLOSURE

Australian Patent Number 641920 incorporated by reference as if fully set forth herein discloses a wall construction shown in FIG. 3 that includes a number of spaced apart, upright channel-shaped studs 118 and a number of concrete panels 126.

Each concrete panel 126 includes a rear face having an outwardly projecting tie member 128 extending therefrom. The tie members 128 project into the channel-shaped studs 118 and engage horizontal bars or pins 130. The panels 126 are arranged to fit together in abutting relation and form an external wall of the completed wall structure.

A U-shaped upper plate 120 facing downwardly is mounted to the top of the row of studs 118 along each wall and receives the upper ends of the studs 118.

In order to secure the U-shaped plate 120 to a stud 118 the upper end of each stud 118 has attached thereto a substantially U-shaped upper bracket 156. Each upper bracket 156 includes a downwardly extending rear flange 157.

The upper bracket 156 is attached to the rear face of a stud 118 by bolts 153 extending through the flange 157 and engaging with the stud 118. The bracket 156 also has an upstanding apertured plate 158 arranged to be connected to a roof truss of known type as shown in FIG. 3.

The bracket 156 also has a horizontal flange 159 which is integrally formed with the flange 157 and extends above the plate 120. Further, there is an additional vertical flange 160 extending downwardly from the flange 159 at the end thereof remote from the flange 157. The flange 160 is so integrally formed with the flange 159. Thus, the bracket 156 wraps around the plate 120 and in conjunction with the bolts 153 firmly secures the plate 120 to the stud 118.

The studs 118 are filled with concrete 132 once the panels 126 have been mounted on the bars 130 and the brackets 156 have been bolted tightly in position. An interior wall 122 is mounted to inner faces of the studs 118 in known manner using horizontal channel members 124.

However, filling the studs 118 with concrete entails removing the upper plate 120 to enable pouring concrete into the studs. Removing the upper plate 120 is very time consuming.

SUMMARY OF THE DISCLOSURE

Disclosed is a wall construction having an upper plate that is secured to the upper ends of the studs that can remain in place when pouring concrete into the studs.

An embodiment of the disclosed wall construction includes a number of spaced apart, upright channel-shaped studs and a number of concrete panels, the concrete panels having rear faces having at least one outwardly projecting tie member extending therefrom, the tie members extending into respective studs, wherein the studs each have mounted thereto adjacent an upper end thereof a laterally extending hollow section arranged to be connected to an upright stud while being disposed away from upper ends of the studs, such that the studs can be filled with concrete with the hollow section remaining in place.

Other objects and features of the disclosure will become apparent as the description proceeds, especially when taken in conjunction with the accompanying drawing sheets illustrating one or more illustrative embodiments.

DETAILED DESCRIPTION

Figure 1:
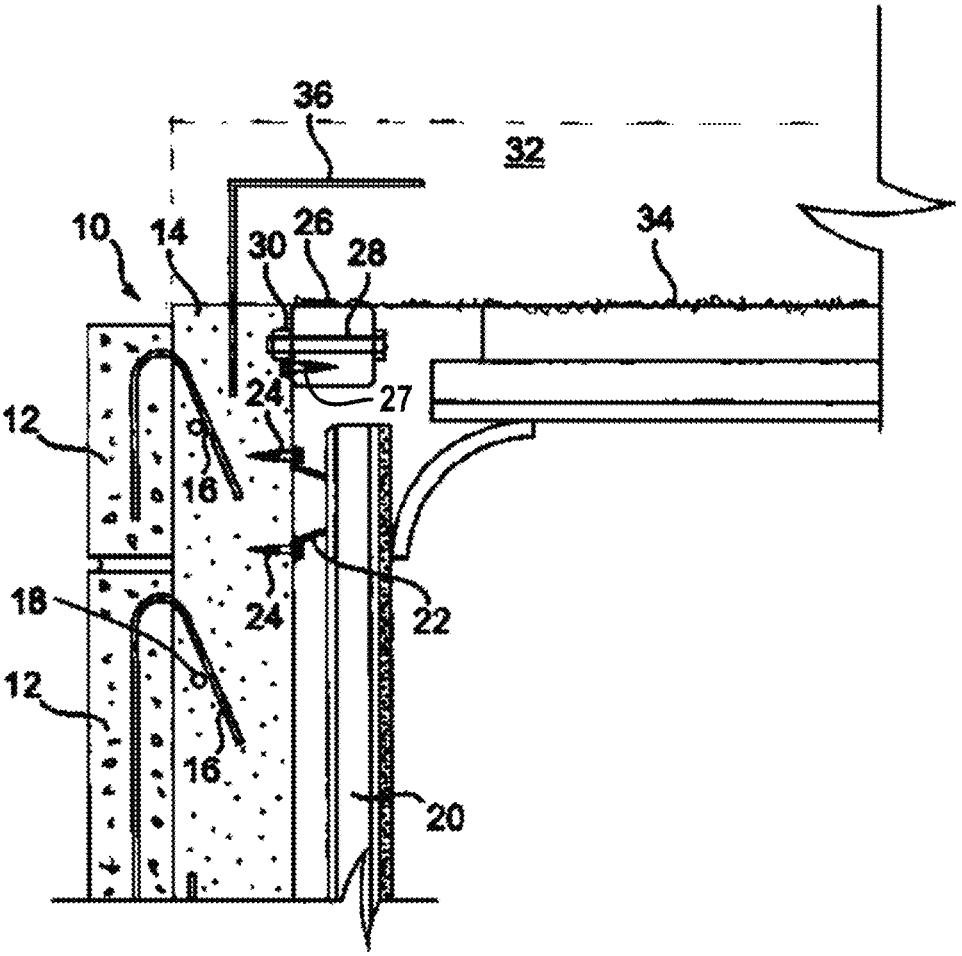
FIG. 1 is a schematic cross sectional view of a part of a wall construction in accordance with the present disclosure.
Figure 2:
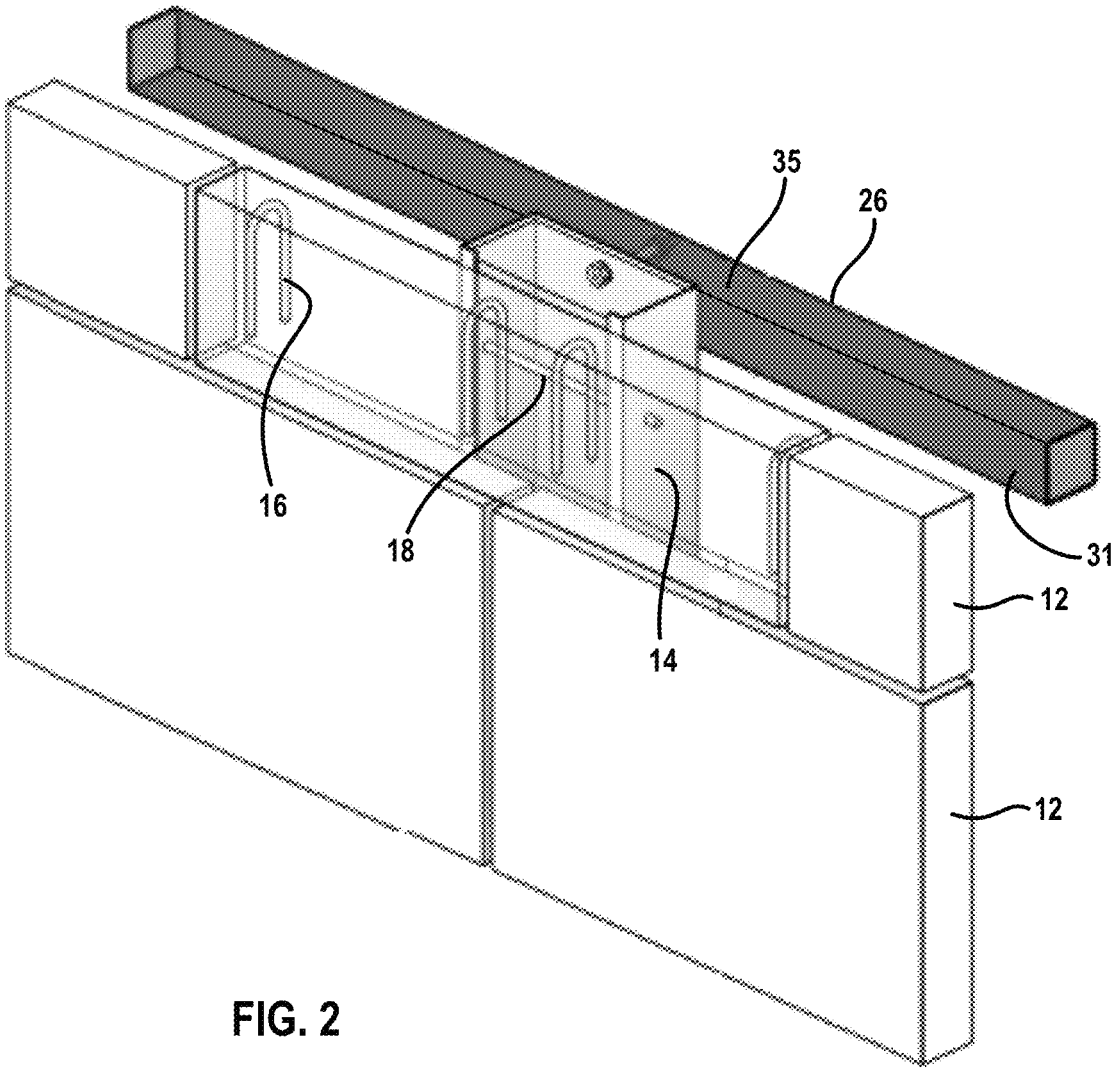
FIG. 2 is a schematic perspective view of the part of the wall construction shown in FIG. 1.

FIGS. 1 and 2 illustrate a wall construction 10 that includes a number of concrete panels 12 and a number of spaced apart, upright channel-shaped studs 14. The studs 14 are spaced apart from one another along the length of the wall construction. The panels 12 are mounted to the studs 14 to form an exterior wall of the completed wall construction 10.

Each panel 12 includes a rearwardly and downwardly•extending tie member 16. The tie members 16 are incorporated into the structure of the panels 12 and extend rearwardly and downwardly into the studs 14. Each stud 14 is oriented so that the channel thereof will face the concrete panels 12.

Further, in the stud 14 the tie members 16 engage with respective pin members 18 which extend laterally across the channel of the stud. A pin member 18 may extend along the wall construction through multiple studs 14.

Still further. the wall construction 10 includes a furring channel 20 which is disposed inwardly of the stud 14. The furring channel 20 is spaced apart from the stud 14 by one or more generally U shaped brackets 22 in contact with the furring channel 20 and connected to the stud 14 by screws 24. The brackets 22 may be made of the same material as the furring channel.

Adjacent an inner wall side of the stud 14 remote from the panels 12 there is provided an elongate support member formed as a hollow section 26. The illustrated support member 26 is hollow in order to minimize the weight of the support member. The illustrated section 26 is square in cross section. In other embodiments the support member 26 may be non-hollow or may have some other cross section such as a non-square rectangle or other shape.

The support member 26 is placed in its desired location with respect to the studs 14. The support member is first attached to the studs by screws 27 passing through the studs and into the support member (the screws are shown only in FIG. 1). The screws temporarily secure the support member to the studs, with the section member's flat side 31 against the studs. Holes are then drilled through the studs and support member and receive bolts 28 having nuts 30 threaded onto the bolts. The nut and bolt connection through each stud 14 permanently attach the support member 26 to the studs and are sized to also support loads on the support member 26 after the studs are filled with concrete as discussed in more detail below.

The section 26 is adjacent the upper ends of the studs 14 and is arranged in the illustrated embodiment to be located essentially flush with the upper ends of the studs 14. The section 26 will be adjacent to and assist in supporting a suspended slab 32 as will be described later below.

Importantly, the section 26 does not obstruct upper access to the studs 14 such that each stud 14 can be filled with concrete while the section 26 remains in place as shown in FIG. 1. The section 26 can be allowed to remain in place after the concrete has set or it can be subsequently removed if desired.

The hollow section 26 in the illustrated embodiment supports in use a metal formwork 34 for forming a slab as will be discussed later below. The section 26 can be positioned vertically with respect to the upper end of the studs 14 to position the upper side of the section 26 having a flat upper surface 35 in the desired vertical location for supporting the formwork 34. The formwork 34 as shown terminates before reaching the studs 14.

Reinforcement bars 36 such as steel bars may be placed in each stud 14 prior to the stud 14 being filled with concrete. As shown the bars 36 extend upwardly from the stud 14 and then laterally to provide reinforcement for a slab 32 to be formed after the stud 14 is filled with concrete.

Thus, once the studs 14 are filled with concrete the concrete slab 32 can be poured on the formwork 34 to form the next level of the construction. The support member 26 may support part of the load of the formwork 34 or the concrete slab and may transfer some or all of the supported load to the studs 14.

Figure 3:
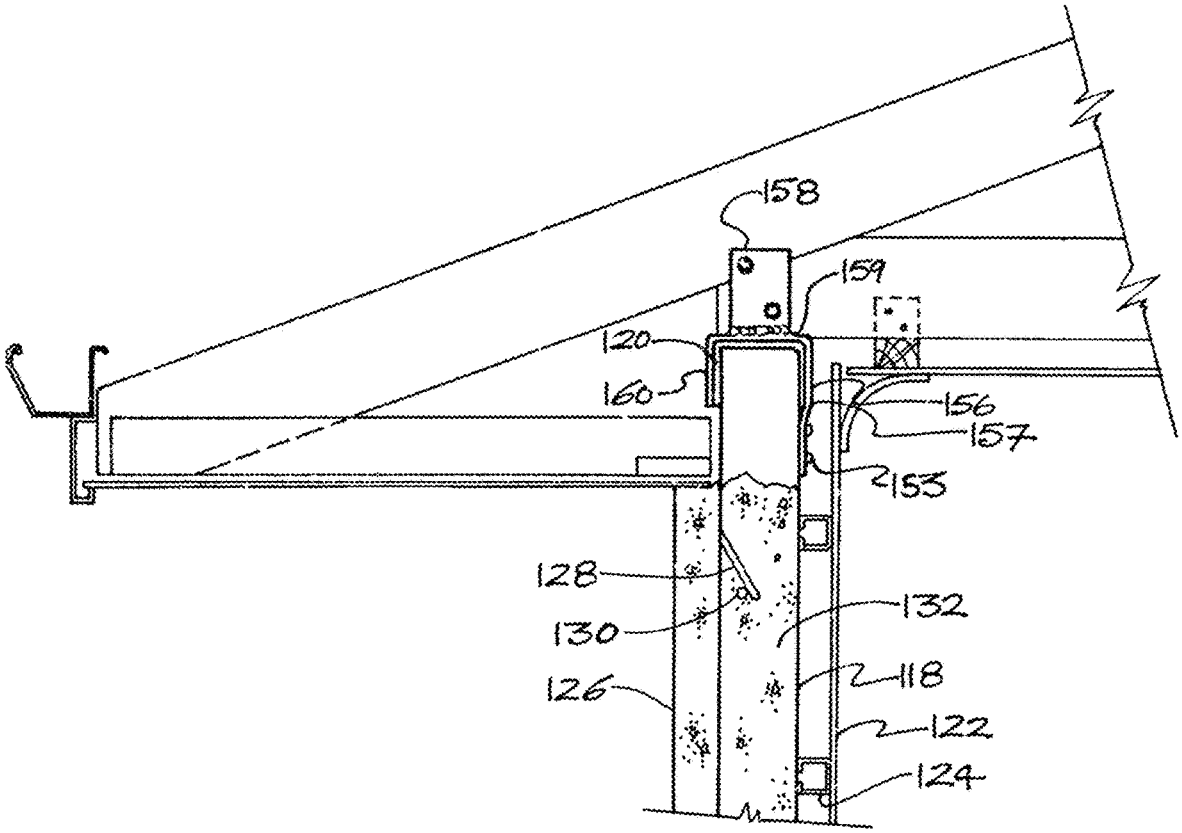
FIG. 3 PRIOR ART
FIG. 3 is a schematic cross sectional view of a part of a prior art wall construction.

The same principal can be applied to a roof structure in which the section 26 can be fixed to a roof truss by means of triple grips, angle brackets, plates (like, for example, the plate 158 in FIG. 3), or other fasteners.

While one or more embodiments have been disclosed and described in detail, it is understood that this is capable of modification and that the scope of the disclosure is not limited to the precise details set forth but includes modifications obvious to a person of ordinary skill in possession of this disclosure, including (but not limited to) changes in material selection, size, operating ranges (temperature, volume, displacement, stroke length, concentration, and the like), environment of use, and also such changes and alterations as fall within the purview of the following claims.

What is claimed is:

1. A wall construction for construction of a building, the wall construction comprising:

a plurality of spaced apart, upright channel-shaped studs, one or more pin members, and a plurality of panels;

the panels having rear faces having at least one outwardly projecting tie member extending therefrom, the tie members extending into the studs;

each stud comprising an open upper end, a first side facing the panels, an opposite second side facing away from the panels, a first wall on the second side of the stud and a pair of opposed second walls extending from the first wall to the first side of the stud, the walls surrounding an empty interior volume of the stud open at the first side of the stud, the open first side of the studs receiving the tie members into the empty interior volume of the studs, the one or more pin members being received into the empty interior volume of the studs and supporting the tie members, the first wall having an inner surface facing the interior volume and an opposite outer surface;

the first side of each stud being covered by a plurality of the panels whereby the panels covering the stud are against the first side of the stud and close the open first side of the stud;

an elongate support member mechanically attached only to the outer surfaces of the first walls of the studs and abutting the first walls of the studs, the support member being capable of supporting building loads thereon and transferring the building loads to the studs;

a first set of fasteners attaching the support member to the first walls of the studs adjacent to the upper ends of the studs, each fastener of the first set of fasteners having a head disposed in the interior volume of the stud and against the first wall of a respective one of the plurality of studs and a shank extending from the head and through an opening in the first wall of the respective stud into the support member, the head being disposed between the pair of second walls, the opening being defined by a surface of the first wall surrounding the shank, the support member not obstructing access to the upper ends of the studs such that the studs can be filled with concrete with the support member remaining in place attached to the studs;

the heads of the first sets of fasteners being uncovered and exposed to the interior volume of the studs whereby should the studs be subsequently filled with concrete, the concrete would contact and cover said heads.

2. The wall construction of claim 1 wherein the support member is a hollow member.

3. The wall construction of claim 2 wherein the support member has a rectangular cross-section.

4. The wall construction of claim 1 wherein the support member is substantially flush with the upper ends of the studs.

5. The wall construction of claim 1 wherein the support member supports at least a portion of the weight of another body on the support member.

6. The wall construction of claim 5 wherein the said another body is a concrete slab.

7. The wall construction of claim 5 wherein the support member has a flat surface that engages the said another body when supporting the said another body.

8. The wall construction of claim 1 comprising a second set of fasteners attaching the support member to the studs, each fastener of the second set of fasteners being a nut threaded onto a bolt.

9. The wall construction of claim 1 wherein the support member is a hollow member having an interior, and the first set of fasteners are screws that terminate within the interior of the support member.

10. The wall construction of claim 1 wherein the support member is disposed above furring channels attached to the studs.

11. The wall construction of claim comprising a second set of fasteners, each fastener of the second set of fasteners being a nut threaded onto a bolt.

12. A wall construction for a building, the wall construction comprising:

a plurality of spaced apart, upright channel-shaped studs and a plurality of panels;

the panels having rear faces having at least one outwardly projecting tie member extending therefrom, the tie members extending into the studs;

each stud comprising an open upper end, a first side facing the panels, an opposite second side facing away from the panels, a first wall on the second side of the stud and a pair of opposed second walls extending from the first wall to the first side of the stud, the walls surrounding an interior volume of the stud open at the first side of the stud, the open first side of the studs receiving the tie members, the first wall having an inner surface facing the interior volume and an opposite outer surface;

the first side of each stud being covered by a plurality of the panels whereby the panels covering the stud are against the first side of the stud and close the open first side of the stud;

an elongate support member mechanically attached only to the outer surfaces of the first walls of the studs and abutting the first walls of the studs, the support member being capable of supporting building loads thereon and transferring the building loads to the studs;

a first set of fasteners attaching the support member to the first walls of the studs adjacent to the upper ends of the studs, each fastener of the first set of fasteners having a head disposed in the interior volume of the stud and against the first wall of a respective one of the plurality of studs and a shank extending from the head and through an opening in the first wall of the respective stud into the support member, the head being disposed between the pair of second walls, the opening being defined by a surface of the first wall surrounding the shank, the support member not obstructing access to the upper ends of the studs such that the studs can be filled with concrete with the support member remaining in place attached to the studs;

the heads of the first sets of fasteners being exposed to the interior volume of the studs; and the studs being filled with concrete, the concrete covering he heads of the first set of fasteners.

13. The wall construction of claim 12 comprising reinforcement bars extending from the concrete out of the upper ends of the studs.

* * * * *